US008532986B2

(12) United States Patent
Matsumoto

(10) Patent No.: US 8,532,986 B2
(45) Date of Patent: Sep. 10, 2013

(54) SPEECH SIGNAL EVALUATION APPARATUS, STORAGE MEDIUM STORING SPEECH SIGNAL EVALUATION PROGRAM, AND SPEECH SIGNAL EVALUATION METHOD

(75) Inventor: Chikako Matsumoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 829 days.

(21) Appl. No.: 12/730,920

(22) Filed: Mar. 24, 2010

(65) Prior Publication Data

US 2010/0250246 A1 Sep. 30, 2010

(30) Foreign Application Priority Data

Mar. 26, 2009 (JP) ..... 2009-76186

(51) Int. Cl.
*G10L 11/06* (2006.01)

(52) U.S. Cl.
USPC ..... 704/214; 704/208; 704/215

(58) Field of Classification Search
None
See application file for complete search history.

(56) References Cited

U.S. PATENT DOCUMENTS

| | | | | |
|---|---|---|---|---|
| 5,732,392 | A | 3/1998 | Mizuno et al. | |
| 6,832,194 | B1 * | 12/2004 | Mozer et al. | 704/270 |
| 7,917,356 | B2 * | 3/2011 | Chen et al. | 704/214 |
| 2003/0091323 | A1 | 5/2003 | Abe | |
| 2003/0212548 | A1 * | 11/2003 | Petty | 704/201 |
| 2005/0038651 | A1 * | 2/2005 | Zhang et al. | 704/233 |
| 2009/0222258 | A1 * | 9/2009 | Fukuda et al. | 704/203 |
| 2009/0319261 | A1 * | 12/2009 | Gupta et al. | 704/207 |

FOREIGN PATENT DOCUMENTS

| | | | |
|---|---|---|---|
| JP | 4-115299 | A | 4/1992 |
| JP | 4-238399 | A | 8/1992 |
| JP | H07-084596 | A | 3/1995 |
| JP | 9-90974 | A | 4/1997 |
| JP | 2000-163099 | A | 6/2000 |
| JP | 2001-309483 | A | 11/2001 |
| JP | 2003-029772 | A | 1/2003 |
| JP | 2007-072005 | A | 3/2007 |
| JP | 2008-015443 | A | 1/2008 |

OTHER PUBLICATIONS

Japanese Office Action mailed Nov. 27, 2012 for corresponding Japanese Application No. 2009-076186, with Partial English-language Translation.

* cited by examiner

*Primary Examiner* — Jesse Pullias
(74) *Attorney, Agent, or Firm* — Fujitsu Patent Center

(57) ABSTRACT

A speech signal evaluation apparatus includes: an acquisition unit that acquires, as a first frame, a speech signal of a specified length from speech signals; a first detection unit that detects, on the basis of a speech condition, whether the first frame is voiced or unvoiced; a variation calculation unit that, when the first frame is unvoiced, calculates a variation in a spectrum associated with the first frame on the basis of a spectrum of the first frame and a spectrum of a second frame that is unvoiced and precedes the first frame in time; and a second detection unit that detects, on the basis of a non-stationary condition based on the variation in spectrum, whether the variation of the first frame satisfies the non-stationary condition.

16 Claims, 9 Drawing Sheets

SPEECH SIGNAL EVALUATION APPARATUS, STORAGE MEDIUM STORING SPEECH SIGNAL EVALUATION PROGRAM, AND SPEECH SIGNAL EVALUATION METHOD

CROSS-REFERENCE TO RELATED APPLICATIONS

This application is based upon and claims the benefit of priority of the prior Japanese Patent Application No. 2009-76186, filed on Mar. 26, 2009, the entire contents of which are incorporated herein by reference.

FIELD

Embodiments described herein relate to a speech signal evaluation apparatus for evaluating a speech signal, a storage medium storing a speech signal evaluation program, and a method for evaluating a speech signal.

BACKGROUND

For example, Japanese Unexamined Patent Application Publication No. 2001-309483 and No. 7-84596 discuss techniques for objective evaluation of speech quality using an original speech signal without noise and a target speech signal to be evaluated.

SUMMARY

According to an aspect of the invention, a speech signal evaluation apparatus includes: an acquisition unit that acquires, as a first frame, a speech signal of a specified length from speech signals stored in a storage unit; a first detection unit that detects, on the basis of a speech condition indicating the presence of speech in a frame, whether the first frame is voiced or unvoiced; a variation calculation unit that, when the first frame is unvoiced, calculates a variation in a spectrum associated with the first frame on the basis of the spectrum of the first frame and the spectrum of a second frame that is unvoiced and precedes the first frame in time; and a second detection unit that detects, on the basis of a non-stationary condition based on the variation in spectrum, whether the variation associated with the first frame satisfies the non-stationary condition. An unvoiced frame is a frame that does not satisfy the speech condition, and a voiced frame is a frame that satisfies the speech condition.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

According to a conventional evaluation test, original speech is subjected to speech signal processing, such as, for example, directional sound reception and noise reduction, and the resultant speech (processed speech) is compared to the original speech, thus evaluating the processed speech. In many cases, original speech to be used for comparison exists in a voiced segment included in processed speech. As for an unvoiced segment, e.g., a noise segment, however, original speech to be used for comparison does not exist in such an unvoiced segment in many cases. According to a system of comparing original speech with processed speech to evaluate the processed speech, if there is no original speech to be used for comparison in an unvoiced segment included in processed speech, the quality of the processed speech cannot be evaluated.

An embodiment is described below with reference to the drawings.

The configuration of a speech signal evaluation apparatus according to the present embodiment is now described.

Figure 1:
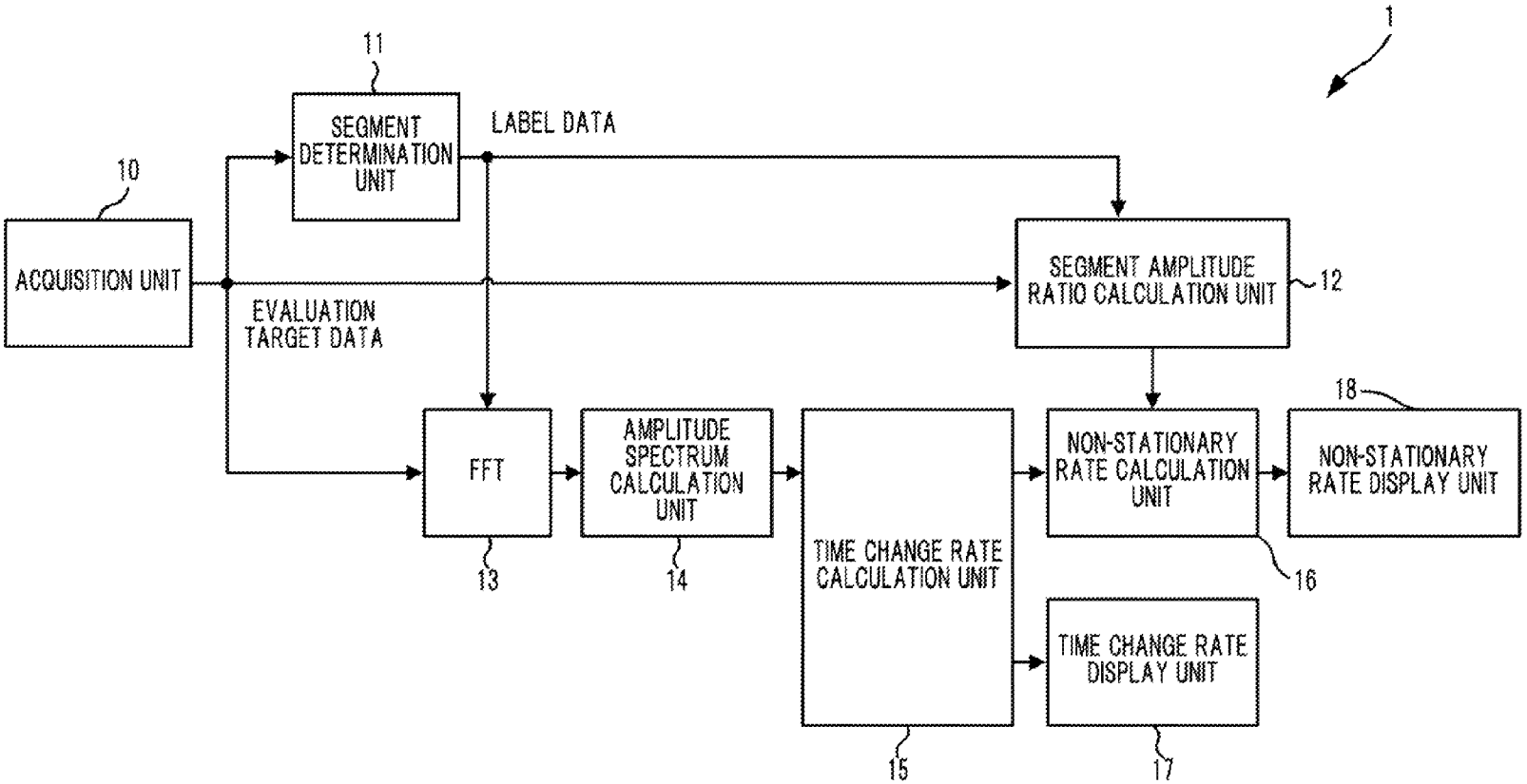
FIG. 1 is a block diagram illustrating functions of a speech signal evaluation apparatus according to an embodiment.

FIG. 1 is a block diagram illustrating functions of the speech signal evaluation apparatus according to the present embodiment. The speech signal evaluation apparatus, indicated at 1, includes an acquisition unit 10, a segment determination unit 11, a segment amplitude ratio calculation unit 12, a fast Fourier transform (FFT) unit 13, an amplitude spectrum calculation unit 14, a time change rate calculation unit 15, a non-stationary rate calculation unit 16, a time change rate display unit 17, and a non-stationary rate display unit 18.

Figure 2:
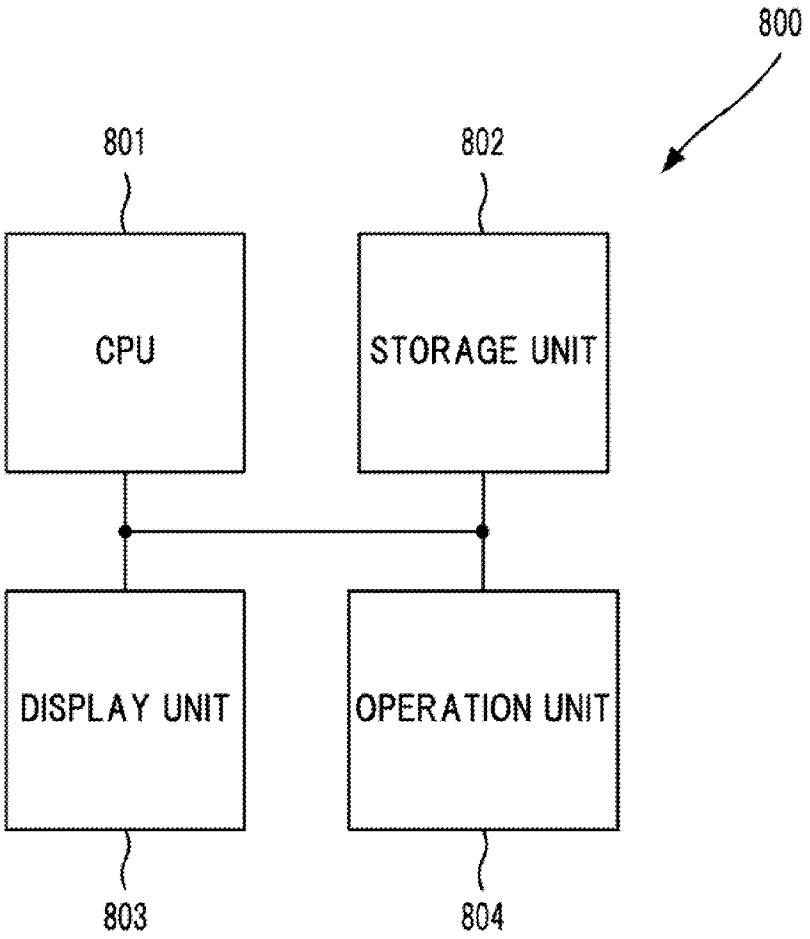
FIG. 2 is a block diagram illustrating the configuration of the speech signal evaluation apparatus according to the embodiment.

FIG. 2 is a block diagram illustrating the configuration of the speech signal evaluation apparatus according to the present embodiment. A computer 800 includes a central processing unit (CPU) 801, a storage unit 802, a display unit 803, and an operation unit 804.

The storage unit 802, e.g., a memory or other computer-readable medium, stores an executable speech signal evaluation program representing the functions of the speech signal evaluation apparatus 1. The CPU 801 executes the speech signal evaluation program stored in the storage unit 802 to implement operations performed by the speech signal evaluation apparatus 1. The operations cause the computer 800 to function as the speech signal evaluation apparatus 1.

The operation unit 804 (e.g., a mouse, keyboard, etc.) acquires an instruction from a user. An output unit outputs a result of evaluation by the speech signal evaluation program or the speech signal evaluation apparatus. For example, the display unit 803 displays a result of evaluation by the speech signal evaluation program or the speech signal evaluation apparatus 1. The storage unit 802 stores target data to be evaluated (hereinafter, "evaluation target data"), the data serving as a speech signal, which may have been previously recorded.

An operation of the speech signal evaluation apparatus 1 is described below.

Figure 3:
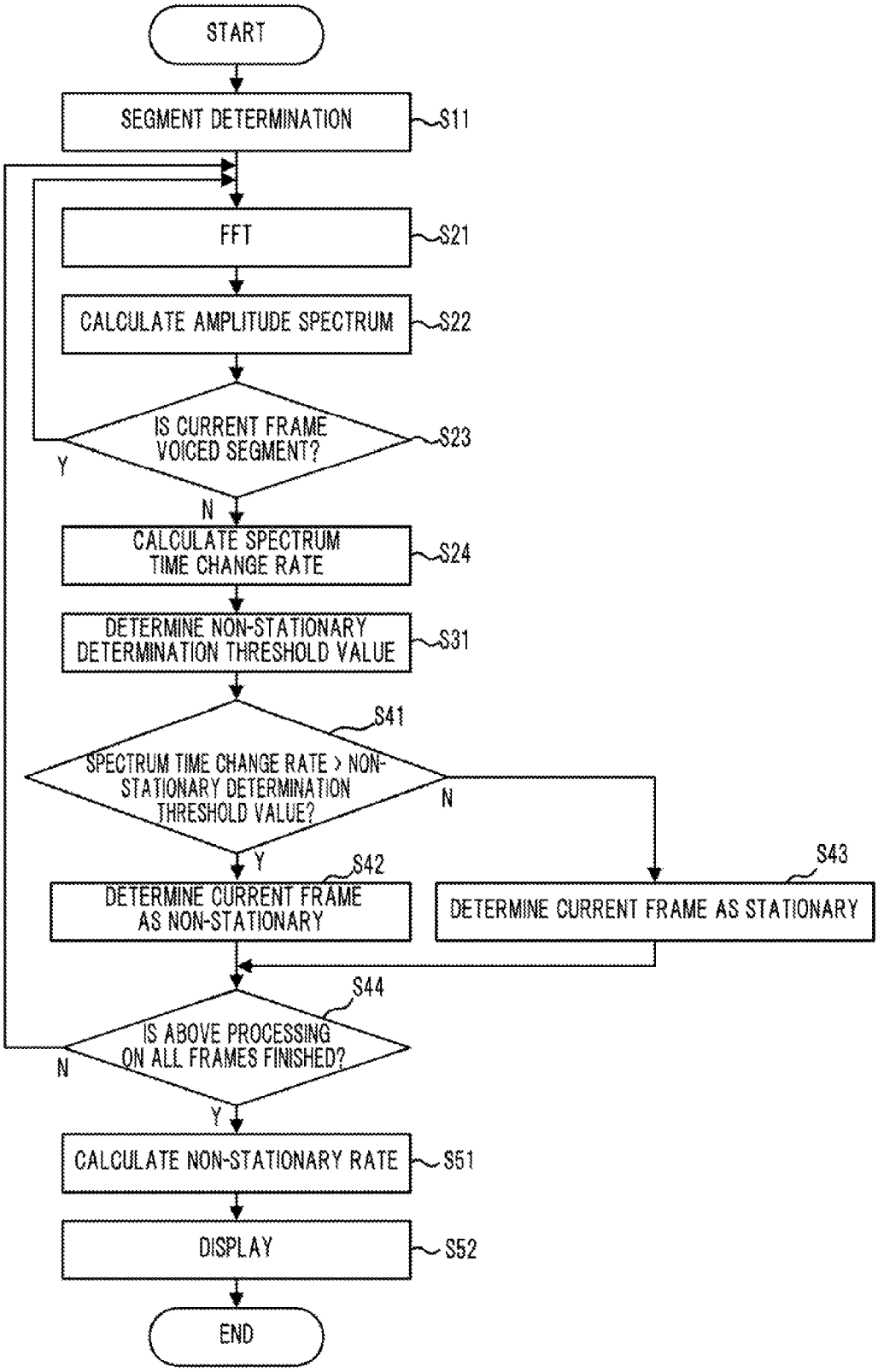
FIG. 3 is a flowchart illustrating an operation of the speech signal evaluation apparatus according to the embodiment.

FIG. 3 is a flowchart illustrating the method (e.g., operations and processes) of the speech signal evaluation apparatus 1 according to the present embodiment.

Speech signals which serve as target evaluation data items in the present embodiment may include not only speech signals subjected to speech signal processing but also typical speech signals, which include noise. The acquisition unit 10 reads evaluation target data included in the storage unit 802 on a frame-by-frame basis, each frame having a specified length. The segment determination unit 11 makes a determination on each read frame on the basis of a speech condition as to whether the frame is a voiced segment or unvoiced segment. The segment determination unit 11 writes the result of determination as label data into the storage unit 802 (S11). As for an example of the speech condition, when the amplitude of the waveform of the evaluation target data is equal to or greater than a voiced threshold value, the segment determination unit 11 determines that the read frame is a voiced segment in which speech exists. Whereas, when the amplitude of the waveform does not exceed the voiced threshold value, the segment determination unit 11 determines that the frame is an unvoiced segment in which speech does not exist. The length of a frame to be read by the acquisition unit 10 corresponds to the length of FFT by the FFT unit 13, for example, $2^N$ (N is an integer). For instance, assuming that a sampling frequency of evaluation target data is 8000 Hz and the length of a frame is set to 256, one frame is 32 msec.

Figure 4:
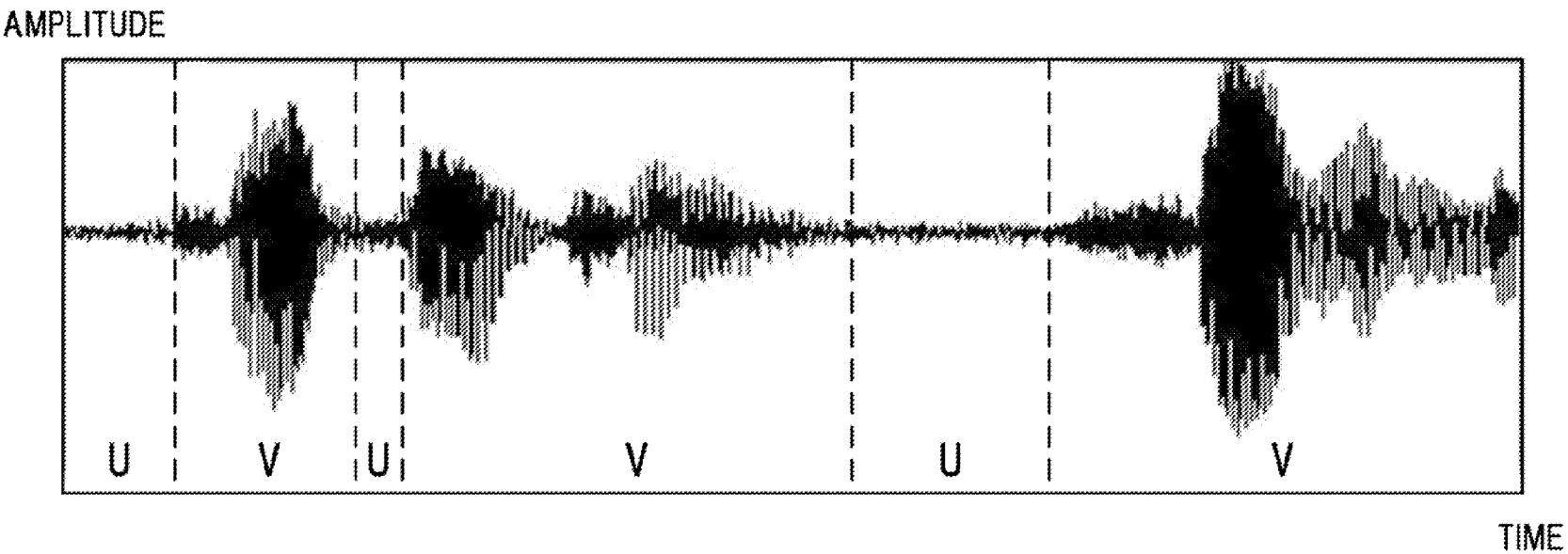
FIG. 4 is a diagram illustrating the waveforms of speech signals and label data.

FIG. 4 is a diagram illustrating example waveforms of speech signals and label data. In FIG. 4, the axis of abscissa indicates time and the axis of ordinate represents the amplitude. V and U each indicate label data. A segment indicated by "V" is a voiced segment and a segment indicated by "U" is an unvoiced segment. The voiced segment is considered to include both speech and noise. The unvoiced segment is considered to not include speech. In other words, the unvoiced segment is considered to include only noise. Each segment U may include many frames. Similarly, each segment V may include many frames. Although the boundary between each U segment and the adjoining V segment matches a boundary between frames in some cases, the boundary between the U and V segments does not necessary match a boundary between frames.

The acquisition unit 10 reads one frame from evaluation target data with written label data from the storage unit 802. The FFT unit 13 performs FFT on the read frame to convert the frame into a frequency domain signal and writes the obtained signal into the storage unit 802 (S21). Hereinafter, the read frame is referred to as a "current frame". If YES in S23, (alternatively, if NO in S44 described later) the acquisition unit 10 reads a frame next to the current frame as a new current frame to be processed in the following S21. The speech signal evaluation apparatus 1 performs the processing in S21 and the subsequent processing on the new current frame, serving as a process target.

The amplitude spectrum calculation unit 14 reads the frequency domain signal from the storage unit 802. The amplitude spectrum calculation unit 14 calculates the amplitude spectrum of the read frequency domain signal and writes the calculated amplitude spectrum into the storage unit 802 (S22).

The time change rate calculation unit 15 reads label data related to the current frame from the storage unit 802 and determines, on the basis of the read label data, whether the current frame is a voiced segment (S23). When the current frame is a voiced segment (YES in S23), the time change rate calculation unit 15 terminates the processing being performed on the current frame, and the method returns to S21.

When the current frame is an unvoiced segment (NO in S23), the time change rate calculation unit 15 reads the amplitude spectrum of a first unvoiced frame, serving as the current frame, from the storage unit 802. In addition, the time change rate calculation unit 15 reads the amplitude spectrum of a preceding frame, serving as an unvoiced frame, just previous to the current frame from the storage unit 802. The preceding frame is referred to herein as a second unvoiced frame. The time change rate calculation unit 15 calculates the time rate of change of spectrum (hereinafter, "spectrum time change rate") to be associated with the current frame on the basis of both of the read amplitude spectra and writes the calculated spectrum time change rate into the storage unit 802 (S24). In this embodiment, the spectrum time change rate is used as an example of the amount of change of spectrum. The spectrum time change rate is a value based on the amount of change from the amplitude spectrum of the current frame from that of the preceding frame.

The segment amplitude ratio calculation unit 12 calculates the ratio (hereinafter, "segment amplitude ratio") of the amplitudes of voiced segments to those of unvoiced segments in the whole of evaluation target data items, for example. As an alternative, the calculation of the segment amplitude ratio may be performed not on the whole of the evaluation target data items but on data items between the current frame and a frame that is several seconds older than the current frame of the evaluation target data items. Furthermore, the segment amplitude ratio calculation unit 12 determines a non-stationary determination threshold value for a non-stationary determination on the basis of the segment amplitude ratio (S31). If the volumes of unvoiced segments are low on the whole and the ratio of the amplitudes of voiced segments to those of the unvoiced segments is large, the sensitivity to the spectrum time change rate is too high. Accordingly, the segment amplitude ratio calculation unit 12 sets a non-stationary determination threshold value.

The non-stationary rate calculation unit 16 determines, on the basis of a non-stationary condition, whether the current frame is a non-stationary frame. As for an example of the non-stationary condition, the non-stationary rate calculation unit 16 determines whether the spectrum time change rate associated with the current frame exceeds the non-stationary determination threshold value (S41). If the spectrum time change rate of the current frame exceeds the non-stationary determination threshold value (YES in S41), the non-stationary rate calculation unit 16 determines that the current frame is a non-stationary frame (S42). If NO in S41, the non-stationary rate calculation unit 16 determines that the current frame is a stationary frame (S43). In this instance, the non-stationary frame is a frame in which a speech signal is non-stationary. For example, when speech signal processing is performed on original speech, musical noise occurs in some cases. The musical noise is an example of non-stationary noises. A stationary frame is a frame in which a speech signal is stationary.

The non-stationary rate calculation unit 16 determines whether the above-described processing on all frames is finished (S44). If the above-described processing on all the frames is not finished (NO in S44), the non-stationary rate calculation unit 16 returns the method shown in FIG. 3 to S21 and allows the next frame to be subjected to the above-described processing.

When the above-described processing on all of the frames is finished (YES in S44), the non-stationary rate calculation unit 16 calculates the number of frames determined as non-stationary in unvoiced segments by the total number of frames in the unvoiced segments. The obtained value is a non-stationary rate (S51). Alternatively, the non-stationary rate calculation unit 16 may divide the number of frames determined as stationary in the unvoiced segments by the total number of frames in the unvoiced segments.

The time change rate display unit 17 reads the spectrum time change rates from the storage unit 802 and displays the read rates in time series. The non-stationary rate display unit 18 displays the non-stationary rate as an evaluation value (S52).

The method (e.g., processes or operations) of the speech signal evaluation apparatus 1 is then terminated.

An operation of the above-described time change rate calculation unit 15 is described in greater detail below.

A first process of calculating a spectrum time change rate, a second process of calculating a spectrum time change rate, and a third process of calculating a spectrum time change rate, namely, three kinds of processes are now described as examples of the operation of the time change rate calculation unit 15. Let t denote time, let i denote a sample number indicating a frequency, and let A(t, i) be an amplitude spectrum in an angular frequency ω(i).

In the first process of calculating a spectrum time change rate, the time change rate calculation unit 15 performs the following calculations. The difference between the amplitude spectrum of the current frame and that of the preceding frame at each frequency is calculated as a spectrum difference. The sum of spectrum differences at all frequencies is obtained as F11. The sum of spectrum amplitudes of the current frame at all the frequencies is calculated as F12. F11 is divided by F12, thus obtaining a value indicating a spectrum time change rate. The spectrum time change rate at time t is expressed by the following equation.

$$\partial A_t = \sum_{i=0}^{n} |A(t, i) - A(t-1, i)| \Big/ \sum_{i=0}^{n} (A(t, i)) \tag{1}$$

In the second process of calculating a spectrum time change rate, the time change rate calculation unit 15 performs the following calculations. The difference between the amplitude spectrum of the current frame and that of the preceding frame at each frequency is calculated as a spectrum difference. A maximum value of spectrum differences at all the frequencies is multiplied by the frame length, thus obtaining a value F21. The sum of spectrum amplitudes of the current frame at all the frequencies is calculated as F22. F21 is divided by F22, thus obtaining a value indicating a spectrum time change rate. Let Max ( ) be a function for calculating a maximum value, the spectrum time change rate at time t is expressed by the following equation.

$$\partial A_t = \mathrm{Max}(|A(t, i) - A(t-1, i)|) \times n \Big/ \sum_{i=0}^{n} (A(t, i)) \tag{2}$$

In the third process of calculating a spectrum time change rate, the time change rate calculation unit 15 performs the following calculations. The difference between the amplitude spectrum of the current frame and that of the preceding frame at each frequency is calculated as a spectrum difference. The spectrum difference is multiplied by a weighting factor α based on auditory characteristics, thus obtaining a weighted spectrum difference. The sum of weighted spectrum differences at all the frequencies is calculated as F31. The sum of spectrum amplitudes of the current frame at all the frequencies is calculated as F32. F31 is divided by F32, thus obtaining a spectrum time change rate. The spectrum time change rate at time t is expressed by the following equation.

$$\partial A_t = \sum_{i=0}^{n} (\alpha \times |A(t, i) - A(t-1, i)|) \Big/ \sum_{i=0}^{n} (A(t, i)) \tag{3}$$

An operation of the above-described segment amplitude ratio calculation unit 12 is described in greater detail below.

A first process of setting a non-stationary determination threshold values, a second process of setting a non-stationary determination threshold value, and a third process of setting a non-stationary determination threshold value, namely, three kinds of processes are described as examples of a method for setting a non-stationary determination threshold value by the segment amplitude ratio calculation unit 12.

In the first process of setting a non-stationary determination threshold value, the segment amplitude ratio calculation unit 12 compares the segment amplitude ratio with a segment amplitude ratio threshold value to determine a non-stationary determination threshold value. For example, when the segment amplitude ratio is greater than the segment amplitude ratio threshold value, the segment amplitude ratio calculation unit 12 sets the non-stationary determination threshold value to 100. When the segment amplitude ratio is less than the segment amplitude ratio threshold value, the segment amplitude ratio calculation unit 12 sets the non-stationary determination threshold value to 70.

In the second process of setting a non-stationary determination threshold value, the segment amplitude ratio calculation unit 12 compares the segment amplitude ratio with a segment amplitude ratio threshold value to determine a non-stationary determination threshold value. For example, when letting x be the segment amplitude ratio, a non-stationary determination threshold value y is expressed by the following equation.

$$y = f(x) \tag{4}$$

The function f(x) is expressed using the constant α of proportion by the following equation.

$$y = \alpha \times x \tag{5}$$

The third process of setting a non-stationary determination threshold value is now described. The amplitude (extent) of variation in the spectrum time change rate in a stationary state varies depending on the kind of noise. A noise with a large variation in the spectrum time change rate differs in auditory perception from a noise with a small variation in the spectrum time change rate, though these noises have the same spectrum time change rate. In the third process of setting a non-stationary determination threshold value, in order to allow a non-stationary determination threshold value to reflect the difference in auditory perception, the segment amplitude ratio calculation unit 12 sets a non-stationary determination threshold value on the basis of the amplitude of variation in the spectrum time change rate.

The segment amplitude ratio calculation unit 12 performs the following calculations. A mean of the spectrum time change rates of all frames in unvoiced segments is calculated as a mean spectrum time change rate. The difference between the spectrum time change rate of each frame and the mean spectrum time change rate is calculated as a spectrum time change rate difference. A mean of spectrum time change rate differences of all the frames in the unvoiced segments is calculated as a mean difference z.

Figure 5:
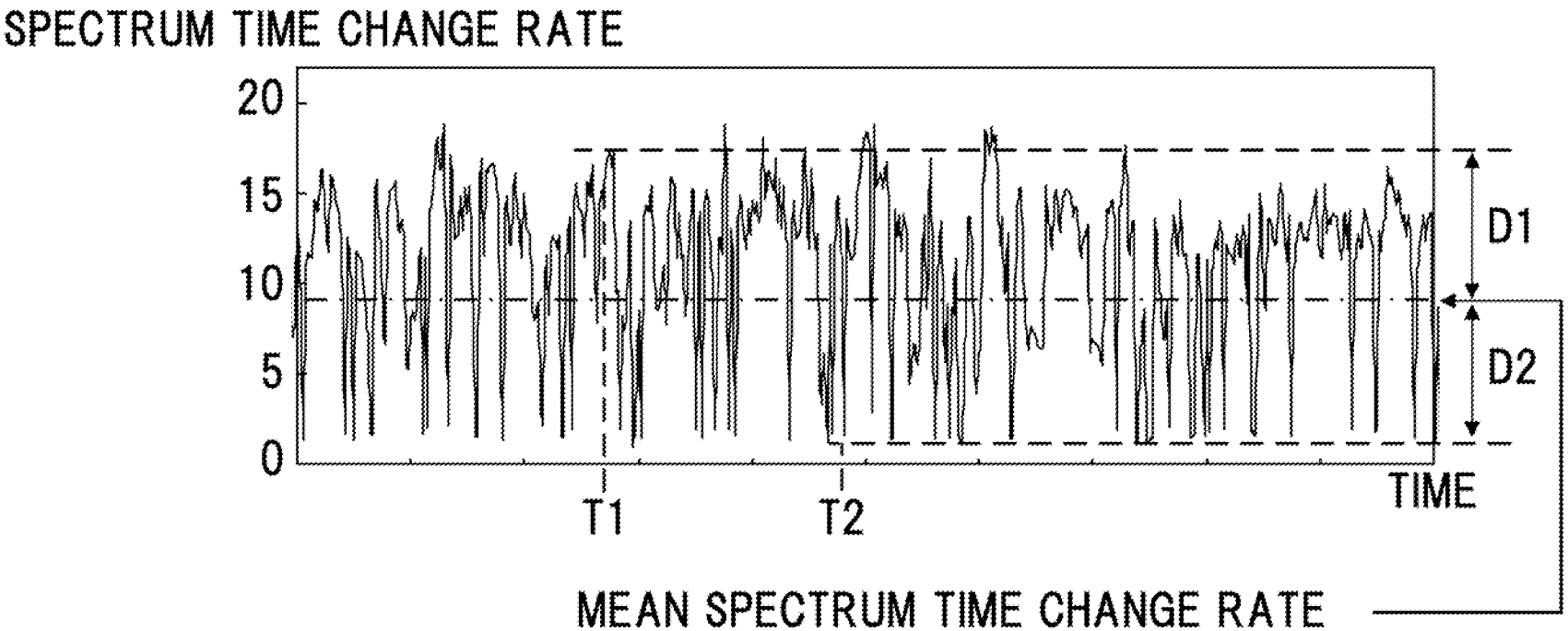
FIG. 5 is a diagram illustrating spectrum time change rate differences obtained by a third process of setting a non-stationary determination threshold value.

FIG. 5 is a diagram illustrating spectrum time change rate differences obtained by the third process of setting a non-stationary determination threshold value. FIG. 5 shows the spectrum time change rate plotted against time. FIG. 5 further illustrates a mean spectrum time change rate, a spectrum time change rate difference D1 at time T1, and a spectrum time change rate difference D2 at time T2.

The non-stationary determination threshold value y is expressed by the following equation.

$$y=f(z) \tag{6}$$

The function f(z) is expressed using, for example, the constant β of proportion by the following equation.

$$y=\beta\times z \tag{7}$$

An operation of the speech signal evaluation apparatus 1 in the use of the third process of setting a non-stationary determination threshold value is described below.

Figure 6:
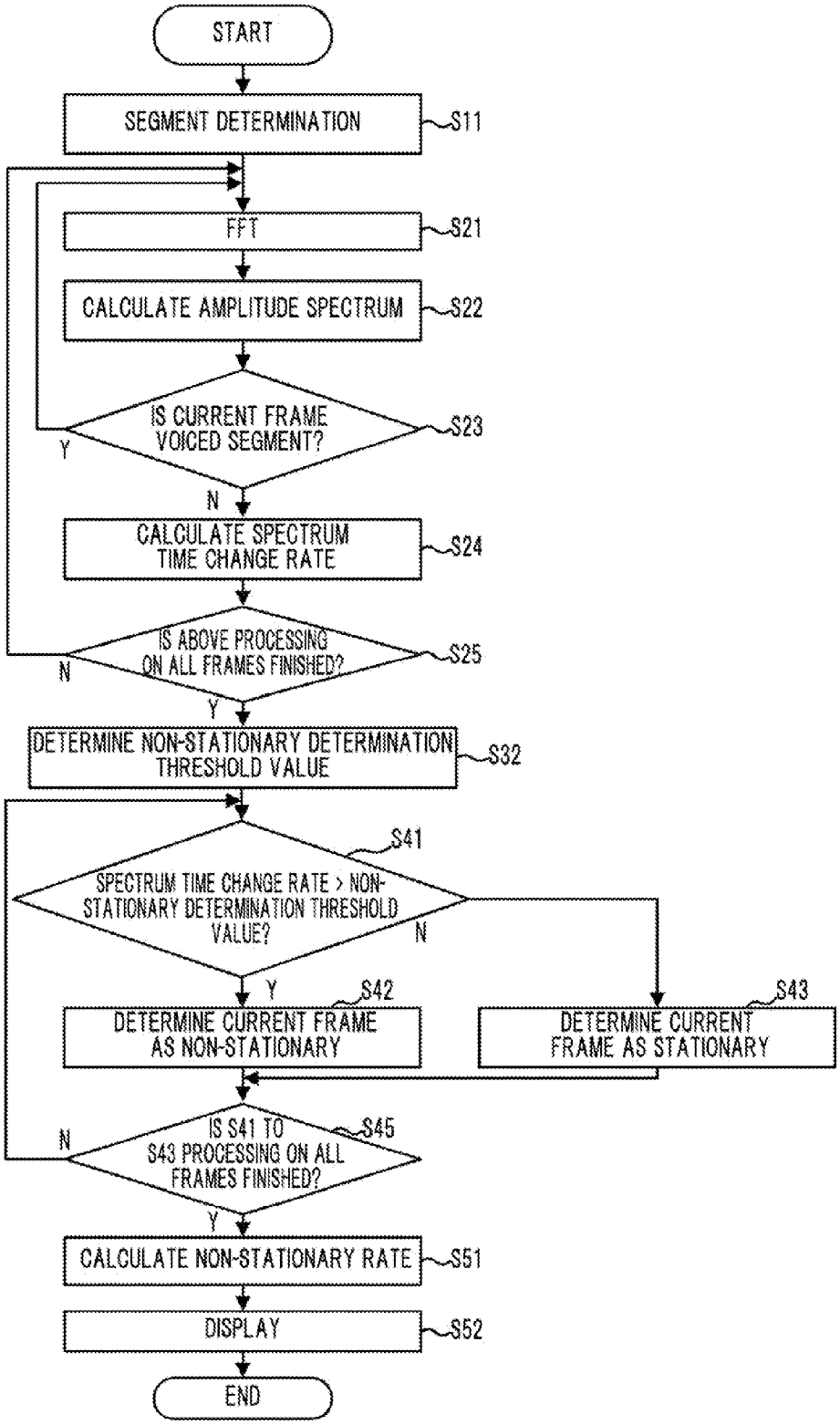
FIG. 6 is a flowchart illustrating an operation of the speech signal evaluation apparatus in the use of the third process of setting a non-stationary determination threshold value.

FIG. 6 is a flowchart illustrating the operation (process) of the speech signal evaluation apparatus 1 in the use of the third process of setting a non-stationary determination threshold value.

S11 to S24 are the same as those in the flowchart of FIG. 3 and thus, the description of S11 to S24 is not repeated herein for the sake of brevity.

The segment amplitude ratio calculation unit 12 determines whether the S21 to S24 processing on all frames is finished (S25). If the S21 to S24 processing on all the frames is not finished (NO in S25), the segment amplitude ratio calculation unit 12 returns the process to S21 and allows the next frame to be subjected to the S21 to S24 processing.

When the S21 to S24 processing on all the frames is finished (YES in S25), the segment amplitude ratio calculation unit 12 determines a non-stationary determination threshold value using the above-described third process of setting a non-stationary determination threshold value (S32).

S41 to S43 are the same as those in the flowchart of FIG. 3 and thus, the description of S41 to S43 is not repeated herein for the sake of brevity.

The non-stationary rate calculation unit 16 determines whether the S41 to S43 processing on all the frames is finished (S45). If the S41 to S43 processing on all the frames is not finished (NO in S45), the non-stationary rate calculation unit 16 returns the method shown in FIG. 6 to S41 and allows the next frame to be subjected to the S41 to S43 processing. When the S41 to S43 processing on all the frames is finished (YES in S45), the non-stationary rate calculation unit 16 allows the method to proceed to S51 and S52.

S51 and S52 are the same as those in the flowchart of FIG. 3 and thus, the description of S51 to S52 is not repeated herein for the sake of brevity.

The above-described first and third processes of setting a non-stationary determination threshold value may be combined. In addition, the above-described second and third processes of setting a non-stationary determination threshold value may be combined.

An operation of the above-described non-stationary rate calculation unit 16 is described in greater detail below.

Figure 7:
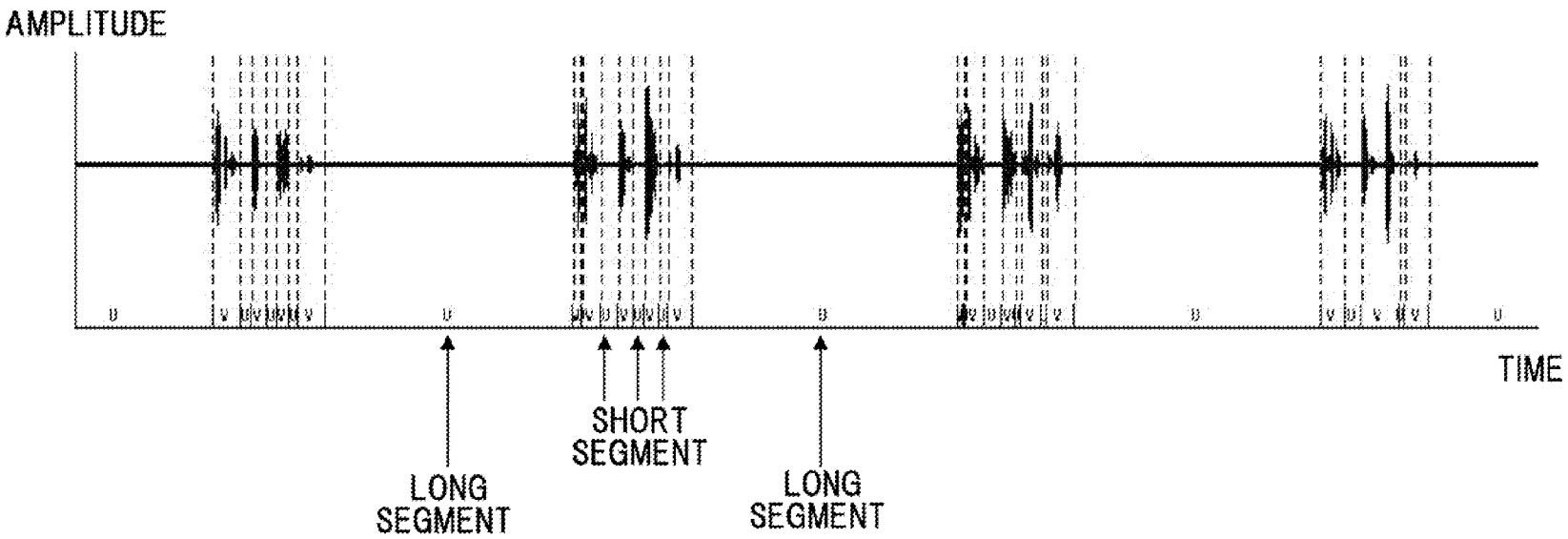
FIG. 7 is a waveform diagram illustrating long segments and short segments.

Unvoiced segments include a long unvoiced segment (long segment) between sentences and a short unvoiced segment (short segment), such as, for example, the interval between breaths or an unvoiced plosive. FIG. 7 is a waveform diagram illustrating long segments and short segments. When a frame determined as non-stationary is included in a long segment, a human auditory sense recognizes that the frame is the non-stationarity of a noise segment, namely, non-stationary noise is included in the noise segment. Whereas, when the frame determined as non-stationary is included in a short segment, the human auditory sense recognizes that the frame is the non-stationarity of a voiced segment, namely, non-stationary noise is included in the voiced segment.

To close the result of detection of non-stationarity to that obtained by the human auditory sense, the non-stationary rate calculation unit 16 may separate unvoiced segments into a long segment and a short segment to calculate non-stationary rates. In this case, the non-stationary rate calculation unit 16 determines, on the basis of the length of an unvoiced segment, whether the segment is a long segment or a short segment. The non-stationary rate calculation unit 16 calculates a non-stationary rate for each of the long and short segments. The non-stationary rate calculation unit 16 determines an unvoiced segment having a unvoiced segment threshold length or longer as a long segment and determines an unvoiced segment having a length shorter than the unvoiced segment threshold length as a short segment.

An operation of the above-described time change rate display unit 17 is described in greater detail below.

Figure 8:
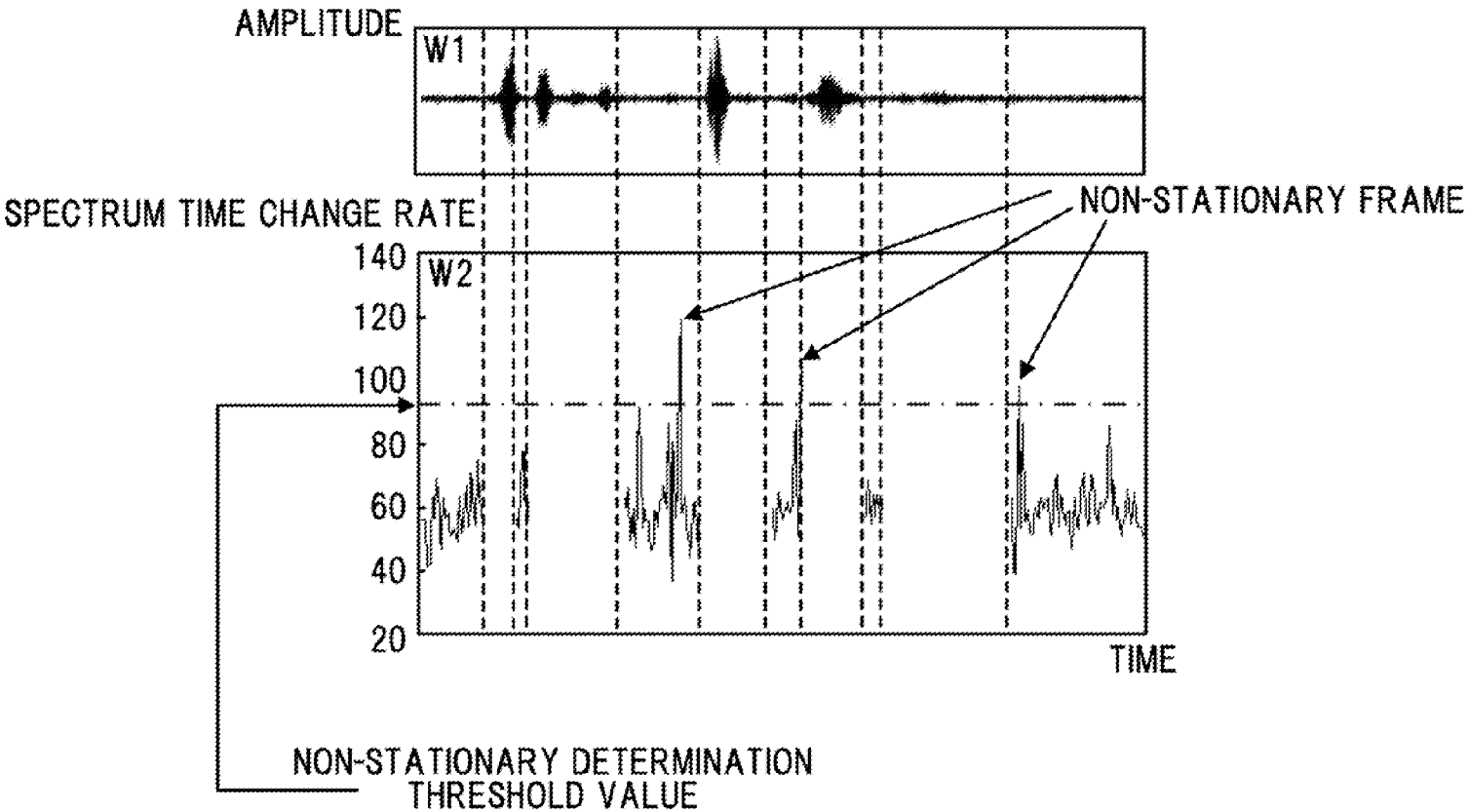
FIG. 8 is a waveform diagram illustrating spectrum time change rates displayed in time series.

FIG. 8 is a waveform diagram illustrating spectrum time change rates displayed in time series. In FIG. 8, the axis of abscissa represents time. In the upper waveform W1, the axis of ordinate represents the amplitude of target data to be evaluated. In the lower waveform W2, the axis of ordinate represents the spectrum time change rate. The axis of abscissa common to the waveforms W1 and W2 represents time. The waveforms W1 and W2 are displayed in association with each other. FIG. 8 further illustrates a non-stationary determination threshold value and three non-stationary frames in the waveform W2. As described above, each non-stationary frame is an unvoiced frame with a spectrum time change rate exceeding the non-stationary determination threshold value.

The time change rate display unit 17 may display the results of determination about stationary or non-stationary for each frame determined by the non-stationary rate calculation unit 16 in time series. For example, when a frame is determined as non-stationary, the frame is displayed as 1. When a frame is determined as stationary, the frame is displayed as 0. The time change rate display unit 17 may display these frames indicated by 1 and 0 in time series.

An operation of the above-described non-stationary rate display unit 18 is described in greater detail below.

As for the display form of an evaluation value displayed by the non-stationary rate display unit 18, one evaluation value may be displayed for each target data to be evaluated. Alternatively, an evaluation value may be displayed for each of long and short segments.

The non-stationary rate display unit 18 may display a non-stationary rate itself as an evaluation value. Alternatively, the non-stationary rate display unit 18 may display a word indicating, for example, "GOOD", "AVERAGE", or "POOR", the word being obtained by converting the non-stationary rate. In this case, one evaluation value may be assigned to each target data to be evaluated. Alternatively, an evaluation value may be assigned to each of long and short segments.

In the case where the non-stationary rate display unit 18 converts a non-stationary rate assigned to each of the long and short segments into a word, such as, for example, "GOOD", "AVERAGE", or "POOR", making a reference of non-stationary rate conversion for a long segment different from that for a short segment is effective in agreeing with human auditory perception. As for a long segment, for example, when the non-stationary rate of a long segment is less than 1.0%, the non-stationary rate is converted into "GOOD". When the non-stationary rate is equal to or greater than 1.0% and is less than 2.0%, the non-stationary rate is converted into "AVERAGE". When the non-stationary rate is equal to or greater than 2.0%, the non-stationary rate is converted into "POOR". As for a short segment, for example, when the non-stationary rate of a short segment is less than 4.0%, the non-stationary rate is converted into "GOOD". When the non-stationary rate is equal to or greater than 4.0% and is less than 8.0%, the non-stationary rate is converted into "AVERAGE". When the non-stationary rate is equal to or greater than 8.0%, the non-stationary rate is converted into "POOR".

The speech signal evaluation apparatus 1 may use a power spectrum instead of the above-described amplitude spectrum.

According to the present embodiment, when the speech signal evaluation apparatus 1 performs speech signal processing, such as, for example, directional sound reception or nose reduction, on an original speech signal including various noises, the apparatus calculates the non-stationarity of an unvoiced segment on the basis of the spectrum time change rate of the unvoiced segment, thus evaluating the quality of the unvoiced segment. According to the present embodiment, the speech signal evaluation apparatus 1 may obtain an objective evaluation value as a quantitative evaluation value that matches subjective evaluation. According to the present embodiment, the speech signal evaluation apparatus 1 may quantify the quality of an unvoiced segment using only a speech signal with various noises subjected to speech signal processing without using original speech for comparison.

According to the present embodiment, the speech signal evaluation apparatus 1 calculates the rate of change of amplitude spectrum represented in a frequency domain, thus detecting the non-stationarity of an unvoiced segment. Consequently, the speech signal evaluation apparatus 1 may specify the position of a non-stationary noise, such as, for example, non-stationary noise of an unvoiced segment or musical noise generated by acoustical treatment, which a human being has known only when he or she actually listened speech subjected to speech signal processing.

The application of a speech signal evaluation method performed by the speech signal evaluation apparatus 1 according to the present embodiment is not limited to an evaluation test. The method may be used not only for the evaluation test but also for a tuning tool to increase the amount of reducing noise in speech signal processing or increase the quality of speech, a noise reduction apparatus for changing parameters while learning in real time, a noise environment measurement evaluation tool, a noise reduction apparatus for selecting an optimum noise reduction process on the basis of a result of noise environment measurement, and the like.

Figure 9:
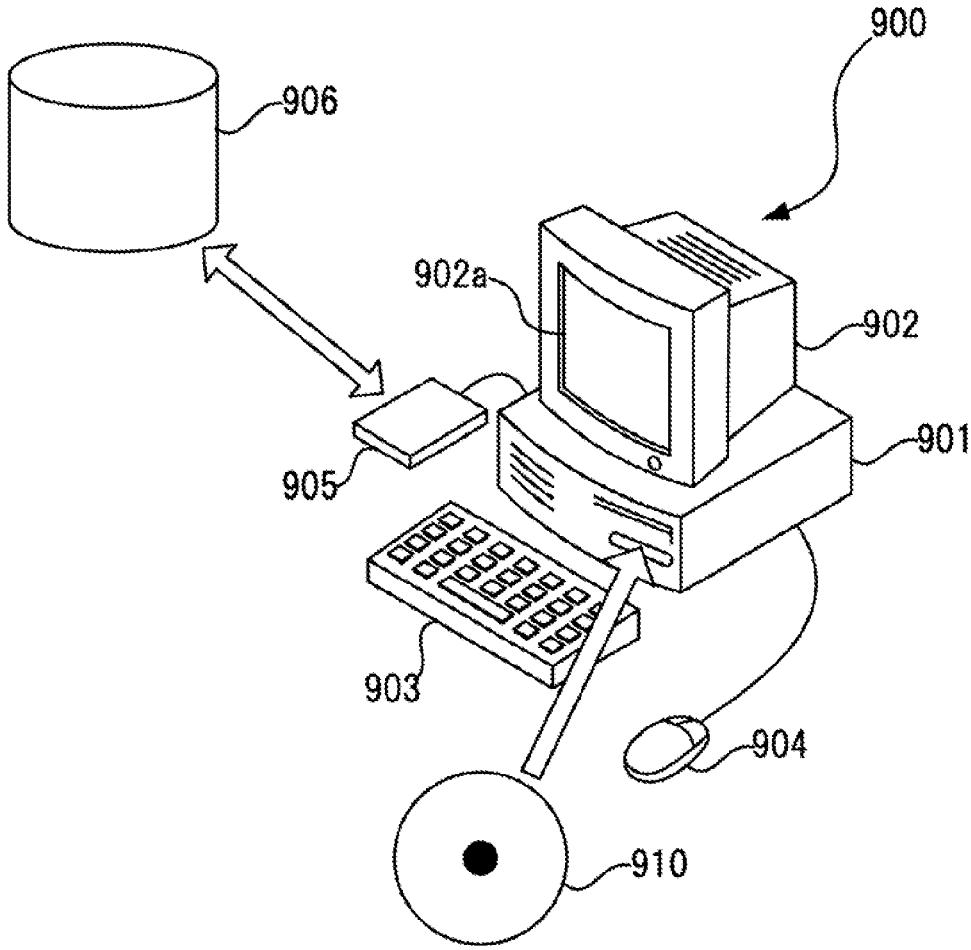
FIG. 9 is a diagram illustrating a computer system to which the embodiment is applied.

The present invention is applicable to a computer system which is described below. FIG. 9 illustrates a computer system to which the embodiments described herein may be applied. Referring to FIG. 9, the computer system, indicated at 900, includes a main body 901 which includes a central processing unit (CPU) and a disk drive, a display 902 which displays an image in accordance with an instruction from the main body 901, a keyboard 903 for inputting various pieces of information to the computer system 900, a mouse 904 which specifies any position on a display screen 902*a* of the display 902, and a communication device 905 which accesses, for example, an external database to download, for instance, a program stored in another computer system. The communication device 905 may be, for example, a network communication card or a modem.

A program that allows a computer system constituting the above-described speech signal evaluation apparatus to execute the above-described processes or operations may be provided as a speech signal evaluation program. This program is stored into a recording medium that is readable by a computer system, so that the computer system constituting the speech signal evaluation apparatus can implement the program. The program that allows the execution of the above-described processes or operations is stored in a portable recording medium, such as a disk 910, or is downloaded through the communication device 905 from a recording medium 906 of another computer system. The speech signal evaluation program that allows the computer system 900 to have at least a speech signal evaluation function is input to the computer system 900 and is compiled therein. This program allows the computer system 900 to operate as a speech signal evaluation system having the speech signal evaluation function.

This program may also be stored in a computer-readable recording medium, e.g., the disk 910. Recording media readable by the computer system 900 include, for example, an internal storage device, such as a ROM or a RAM, installed in a computer, a portable storage medium, such as the disk 910, a flexible disk, a digital versatile disk (DVD), a magneto-optical disk, or an IC card, a database holding a computer program, another computer system, a database thereof, and various recording media accessible through a computer system connected via communication means like the communication device 905.

The main body 901 corresponds to the above-described CPU 801 and storage unit 802.

A first detection unit corresponds to the segment determination unit 11 in the embodiment. A spectrum calculation unit corresponds to the FFT unit 13 and the amplitude spectrum calculation unit 14 in the embodiment. A variation calculation unit corresponds to the time change rate calculation unit 15 in the embodiment. A second detection unit corresponds to the non-stationary rate calculation unit 16 in the embodiment.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present invention(s) has(have) been described in detail, it should be understood that the various changes, substitutions, and alterations could be made hereto without departing from the spirit and scope of the invention.

What is claimed is:

1. A speech signal evaluation apparatus comprising:

a processor; and a memory storing speech signals and a plurality of instructions, which when executed by the processor, cause the processor to execute, acquiring, as a first frame, a speech signal of a specified length from the speech signals stored in the memory;

detecting, on the basis of a speech condition indicating a presence of speech, whether the first frame is voiced or unvoiced, wherein an unvoiced frame does not satisfy the speech condition and a voiced frame does satisfy the speech condition;

calculating, when the first frame is unvoiced, a variation in a spectrum associated with the first frame on the basis of a spectrum of the first frame and a spectrum of a second frame, the second frame being unvoiced and preceding the first frame in time; and detecting, on a basis of a non-stationary condition based on the variation in spectrum, whether the variation satisfies the non-stationary condition, wherein the variation in the spectrum is calculated on the basis of an absolute value of a difference between the spectrum of the first frame and the spectrum of the second frame at each frequency.

2. The speech signal evaluation apparatus according to claim 1, further comprising:

an evaluation of the speech signal based on at least one of the variation in spectrum and a non-stationary rate.

3. A computer-readable non-transitory medium storing a speech signal evaluation program, which when executed by a computer, causes the computer to execute:

acquiring, as a first frame, a speech signal of a specified length from speech signals stored in a memory;

detecting, on the basis of a speech condition indicating a presence of speech in a frame, whether the first frame is voiced or unvoiced, wherein an unvoiced frame does not satisfy the speech condition and a voiced frame does satisfy the speech condition;

calculating, when the first frame is unvoiced, a variation in a spectrum associated with the first frame on the basis of a spectrum of the first frame and a spectrum of a second frame, the second frame being unvoiced and preceding the first frame in time; and detecting, on the basis of a non-stationary condition based on the variation in spectrum, whether the variation satisfies the non-stationary condition, wherein the variation in the spectrum is calculated on the basis of an absolute value of a difference between the spectrum of the first frame and the spectrum of the second frame at each frequency.

4. The medium according to claim 3, wherein the execution of the speech signal evaluation program further causes the computer to execute:

outputting an evaluation of the speech signal based on at least one of the variation in spectrum and a non-stationary rate.

5. The medium according to claim 3, wherein the variation in the spectrum is calculated on the basis of a ratio of a value obtained by adding the absolute values of the differences at all frequencies to a value obtained by adding spectrum components of the first frame at all the frequencies.

6. The medium according to claim 3, wherein the variation in the spectrum is calculated on the basis of a ratio of a value obtained by multiplying a maximum value of the absolute values of the differences at all frequencies by a frame length to a value obtained by adding spectrum components of the first frame at all the frequencies.

7. The medium according to claim 3, wherein the variation in the spectrum is calculated on the basis of a ratio of a value obtained by adding the absolute values, weighted based on auditory characteristics, of the differences at all frequencies to a value obtained by adding spectrum components of the first frame at all the frequencies.

8. The medium according to claim 3, wherein the execution of the speech signal evaluation program further causes the computer to execute:

setting successive unvoiced frames in the speech signals as one group; and calculating a non-stationary rate as a ratio of a number of unvoiced frames included in the group to a number of frames satisfying the non-stationary condition of the unvoiced frames in the group.

9. The medium according to claim 3, wherein the execution of the speech signal evaluation program further causes the computer to execute:

identifying, when a length of successive unvoiced frames in the speech signals is equal to or greater than a threshold value, each of the successive unvoiced frames as a long unvoiced frame; setting the successive long unvoiced frames as one group; and calculating a ratio of a number of the long unvoiced frames included in the group to a number of frames satisfying the non-stationary condition of the long unvoiced frames in the group.

10. The medium according to claim 3, wherein the execution of the speech signal evaluation program further causes the computer to execute:

identifying, when a length of successive unvoiced frames in the speech signals is less than a threshold value, each of the successive unvoiced frames as a short unvoiced frame; setting the successive short unvoiced frames as one group; and calculating a ratio of a number of short unvoiced frames included in the group to a number of frames satisfying the non-stationary condition of the short unvoiced frames in the group.

11. The medium according to claim 3, wherein the non-stationary condition indicates that a variation in the frame exceeds a set variation threshold value.

12. The medium according to claim 11, wherein the execution of the speech signal evaluation program further causes the computer to execute:

calculating an amplitude ratio of amplitudes of voiced frames to amplitudes of unvoiced frames in the speech signals to determine the variation threshold value on the basis of the amplitude ratio.

13. The medium according to claim 11, wherein the execution of the speech signal evaluation program further causes the computer to execute:

setting the first frame and unvoiced frames continuous with the first frame in the speech signals as one group;

calculating a mean spectrum in the group;

calculating a magnitude of a difference between the spectrum of the first frame and the mean spectrum; and determining the variation threshold value on the basis of the magnitude of the difference.

14. The medium according to claim 3, wherein the speech condition is based on a voiced threshold value, and when an amplitude of a waveform of the first frame is equal to or greater than the voiced threshold value, the first frame is voiced, and when the amplitude of the waveform of the first frame does not exceed the voiced threshold value, the first frame is unvoiced.

15. A speech signal evaluation method executed by a computer, the speech signal evaluation method comprising:

acquiring, as a first frame, a speech signal of a specified length from speech signals stored in a memory;

detecting, on the basis of a speech condition indicating a presence of speech in a frame, whether the first frame is voiced or unvoiced, wherein an unvoiced frame does not satisfy the speech condition and a voiced frame does satisfy the speech condition;

calculating, when the first frame is unvoiced, a variation in a spectrum associated with the first frame on the basis of a spectrum of the first frame and a spectrum of a second frame, the second frame being unvoiced and preceding the first frame in time; and detecting, on the basis of a non-stationary condition based on the variation in spectrum, whether the variation satisfies the non-stationary condition, wherein the variation in the spectrum is calculated on the basis of an absolute value of a difference between the spectrum of the first frame and the spectrum of the second frame at each frequency.

16. The method according to claim 15, further comprising:

outputting an evaluation of the speech signal based on at least one of the variation in spectrum and a non-stationary rate.

* * * * *